US006845110B2

(12) United States Patent
Gibson

(10) Patent No.: US 6,845,110 B2
(45) Date of Patent: Jan. 18, 2005

(54) VAPOR CYCLE SYSTEM (VCS) WITH THERMAL RESERVOIRS FOR REDUCING REQUISITE VCS POWER AND SIZE WITH INTERMITTENT HEAT LOADS

(75) Inventor: Richard A. Gibson, Torrance, CA (US)

(73) Assignee: Honeywell International Inc., Morristown, NJ (US)

( * ) Notice: Subject to any disclaimer, the term of this patent is extended or adjusted under 35 U.S.C. 154(b) by 6 days.

(21) Appl. No.: 10/295,191

(22) Filed: Nov. 14, 2002

(65) Prior Publication Data

US 2004/0095974 A1 May 20, 2004

(51) Int. Cl.[7] ..... H01S 3/04
(52) U.S. Cl. ..... 372/35; 372/34
(58) Field of Search ..... 372/34–35

(56) References Cited

U.S. PATENT DOCUMENTS 3,569,860 A * 3/1971 Booth ..... 372/35
3,611,190 A * 10/1971 Keefe, Jr. ..... 372/35
3,869,870 A * 3/1975 Kuehner ..... 62/114
4,150,341 A * 4/1979 Ferguson ..... 372/35
4,163,199 A * 7/1979 Treanor ..... 372/35
4,586,185 A * 4/1986 DeWilde et al. ..... 372/34
4,802,338 A 2/1989 Oswalt et al.
4,850,201 A 7/1989 Oswalt et al.
5,327,442 A * 7/1994 Yarborough et al. ..... 372/35
5,353,293 A 10/1994 Shull
5,477,706 A * 12/1995 Kirol et al. ..... 62/480
5,491,982 A 2/1996 Gowens
5,608,748 A 3/1997 Reimer et al.

* cited by examiner

*Primary Examiner*—Minsun Oh Harvey
*Assistant Examiner*—James Menefee
(74) *Attorney, Agent, or Firm*—Oral Caglar, Esq.

(57) ABSTRACT

A system for providing coolant to a heat load includes a first coolant reservoir providing coolant to the heat load and a second coolant reservoir receiving used coolant after passing through the heat load. The used coolant is refreshed by a cooling apparatus which receives the used coolant from the second coolant reservoir, cools the used coolant, and supplies refreshed coolant to said first coolant reservoir. The resulting dual reservoir system offers significant reductions in the size, weight and power of the vapor cycle system (VCS) equipment while providing for accurate temperature control of the coolant delivered to the heat load.

29 Claims, 1 Drawing Sheet

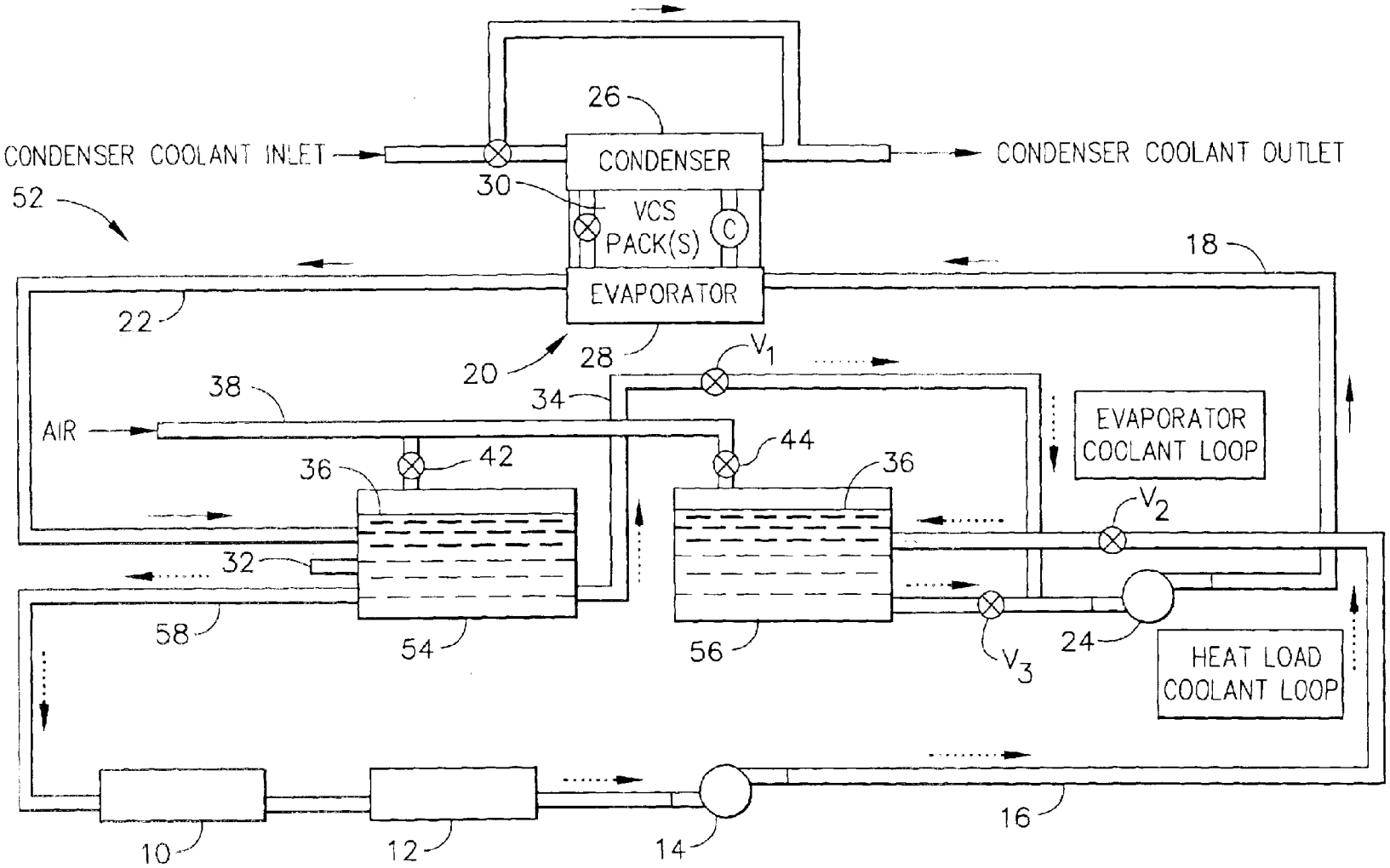
CONDENSER COOLANT OUTLET
CONDENSER COOLANT INLET
CONDENSER
VCS PACK(S)
EVAPORATOR
EVAPORATOR COOLANT LOOP
HEAT LOAD COOLANT LOOP
AIR
10
12
14
16
18
20
22
24
26
28
30
32
34
36
38
42
44
52
54
56
58
V1
V2
V3

VAPOR CYCLE SYSTEM (VCS) WITH THERMAL RESERVOIRS FOR REDUCING REQUISITE VCS POWER AND SIZE WITH INTERMITTENT HEAT LOADS

BACKGROUND OF THE INVENTION

The present invention relates generally to a coolant providing system having thermal reservoirs for reducing the requisite system power and size, and, more specifically, to a vapor cycle system (VCS) which provides apparatus and methods for providing a coolant to a heat load. The present invention is especially beneficial for applications having intermittent heat loads which require a high degree of accurate temperature control.

Solid state lasers are known to use various cooling devices to prevent a thermal overload. In many applications, solid state lasers require a precisely controlled inlet coolant temperature. A high power solid state laser could potentially require in excess of 100 tons instantaneous cooling during laser firing. A conventional system would require significant space and weight consumption while also being extremely power intensive.

U.S. Pat. No. 5,608,748 discloses a cooling liquid flowing from a reservoir, through the laser cavity, and back to the reservoir. The coolant is chilled within the reservoir with a cooling element. Precision cooling, however, is difficult, as the spent coolant is returned to the reservoir and mixed with the supply coolant. A large reservoir and/or a high power cooling element is required to approach the achievement of a suitable precision thermal control.

U.S. Pat. No. 4,850,201 discloses a cooling liquid flowing from a reservoir, through the heat load (such as an industrial laser machine or an injection molding machine for plastic), and back to the reservoir. The disclosure describes controlling overcooling of the coolant by optionally removing a portion of the coolant from the loop and warming the liquid in a heat exchanger until the overcooling situation is corrected. In order to maintain precision thermal control, especially when used for intermittent high heat loads, a large reservoir and high cooling power is required.

As can be seen, there is a need for an improved apparatus and method for a cooling system that provides precision thermally controlled coolant to a heat load. Furthermore, there exists a need to provide such a cooling system which is neither reliant upon an extraordinarily large coolant reservoir nor a large power supply.

SUMMARY OF THE INVENTION

In one aspect of the present invention, a system for providing coolant to a heat load comprises a first coolant reservoir providing coolant to the heat load; a second coolant reservoir receiving used coolant after passing through the heat load; and a cooling means for receiving the used coolant from the second coolant reservoir, cooling the used coolant, and supplying coolant to the first coolant reservoir.

In another aspect of the present invention, a method for providing coolant to a heat load comprises providing a first coolant reservoir and a second coolant reservoir; chilling coolant in the first coolant reservoir to provide a usable coolant; passing the usable coolant from the first coolant reservoir through the heat load to the second coolant reservoir, the usable coolant becoming used coolant after passing through the heat load; and passing the used coolant from the second coolant reservoir, through a cooling means, back to the first coolant reservoir, the used coolant becoming usable coolant after passing through the cooling means.

In another aspect of the present invention, a vapor cycle system for cooling a laser heat load comprises a first coolant reservoir; a second coolant reservoir; a heat load coolant loop circulating coolant from the first coolant reservoir, to the laser heat load, and returning used coolant to the second coolant reservoir; a cooling means; and an evaporator coolant loop circulating used coolant from the second coolant reservoir, through the cooling means, cooling the coolant, and supplying coolant to the first coolant reservoir.

In another aspect of the present invention, a vapor cycle system for cooling a laser heat load comprises a first water reservoir for storing coolant chilled to a predetermined temperature; a second water reservoir for receiving used coolant; a heat load coolant loop communicating the first water reservoir with the laser heat load, and the laser heat load with the second water reservoir; a first pump circulating coolant through the laser heat load in the heat load coolant loop; cooling means, the cooling means having a condenser, an evaporator, and at least one VCS pack; an evaporator coolant loop communicating the second water reservoir with the cooling means, and the cooling means with the first water reservoir; a second pump circulating coolant through the cooling means in the evaporator coolant loop, whereby the used coolant is chilled to the predetermined temperature and returned to the first water reservoir.

These and other features, aspects and advantages of the present invention will become better understood with reference to the following drawings, description and claims.

BRIEF DESCRIPTION OF THE DRAWINGS

The FIGURE is a schematic diagram showing the VCS of the present invention.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In general, the present invention is a coolant providing system having at least two thermal reservoirs. More particularly, the present invention relates to a vapor cycle system having a cold coolant reservoir and a hot coolant reservoir. Additionally, the present invention provides a method for providing a coolant to a heat load. The present invention is especially beneficial for applications having intermittent heat loads, such as solid state lasers, which require a high degree of accurate temperature control. In these cases the Vapor Cycle System Pack can be sized for the average heat load rather than the instantaneous heat load, resulting in a significant reduction in the size and weight of the Vapor Cycle System Pack. The lower the duty cycle of the heat load the greater the reduction in the size and weight of the pack.

In conventional vapor cycle cooling systems, using a circulating liquid as the coolant, precision cooling, especially for intermittent high heat loads, is inadequate. Moreover, such conventional systems require a large coolant reservoir, require a high power cooling element, and/or have a considerable mass occupying a large volume.

Referring to the FIGURE, a VCS system 52 may have a cold water reservoir 54 and a hot water reservoir 56. Cold water reservoir 54 and hot water reservoir 56 may be thermally insulated reservoirs, thereby permitting minimal heat exchange between the stored coolant water and the environment. A cold water output line 58 may bring cold water from cold water reservoir 54 to a heat load. In one embodiment of the present invention, the heat load may include a first laser heat load 10 and a second laser heat load 12. A first pump 14 may carry the used coolant, via a hot water reservoir input line 16, to hot water reservoir 56. A valve $V_2$ may control the flow of coolant through this heat load water loop as shown by the dotted-lined arrows.

The coolant in hot water reservoir 56 may be driven, via a second pump 24, through a hot water reservoir output line 18, through cooling system 20, returning to cold water reservoir 54 via a cold water reservoir input line 22. Cooling system 20 may include a condenser 26, an evaporator 28, and a sufficient number of VCS packs 30 to provide for the average (not instantaneous) heat removal requirements. A valve $V_3$ may control the flow of coolant through this evaporator water loop as shown by the solid arrows.

A temperature sensor 32 may be provided in cold water reservoir 54 for monitoring the coolant temperature and precisely controlling the inlet coolant to the correct temperature via a controls loop (not shown). A cooldown loop output line 34 circulates the coolant, via hot water reservoir output line 18, through cooling system 20 as necessary to maintain the desired coolant output temperature. A valve $V_1$ may be provided in cooldown loop output line 34 to appropriately regulate the flow of coolant through cooldown loop output line 34.

A diaphragm 36 may be provided within each of cold water reservoir 54 and hot water reservoir 56. Air contained within the coolant significantly limits the heat capacity of the coolant. Diaphragm 36 is designed to limit the amount of air contained in the coolant by isolating the coolant from the air at the head of the coolant reservoirs. Preferably, air is delivered via air pressure line 38 to supply adequate pressure from diaphragm 36 onto the surface of the coolant in the reservoirs.

In one alternate embodiment of the present invention, at least one of pumps 14 and 24 may be removed. Pressure on the coolant via diaphragms 36 would then be used to move the coolant through VCS system 52. Coolant pressure may be adjusted appropriately by regulating valves 42 and 44.

EXAMPLE

Referring still to the FIGURE, one embodiment of the present invention, uses VCS system 52 to provide precise thermal control to a first laser heat load 10 and a second laser heat load 12. First laser heat load 10 requires a coolant controlled input temperature of approximately 40° F. The coolant output from first laser heat load 10 is fed to second laser heat load 12.

Initially, the cold water reservoir 54 is filled with about 170 lbs of ambient temperature water. While less water may be used in this example, excess water is preferred so that there is no chance of the system running dry. In this "cool down" operating condition, valve $V_1$ is opened and pump 24 feeds the ambient temperature water through cooldown loop output line 34, hot water reservoir output line 18, and cooling system 20. The output coolant, having the precisely controlled inlet temperature, returns to cold water reservoir 54 via cold water reservoir input line 22. Preferably, water flows through the system during this initial cool down phase at a flow rate of X lbm/sec, where X is a flow capable of achieving the desired cooling effect. When temperature sensor 32 detects the cold water reservoir coolant temperature to be controlled to the desired temperature, the VCS system 52 is operational and ready to cool a heat load.

During the "heat load on" stage, valve $V_1$ is closed. Suppose the duty cycle (ratio of laser on-time to total cycle time) is 33 percent. Valve $V_2$ is opened and pump 14 feeds the coolant water, at a flow rate of 3X lbm/sec, from cold water reservoir 54 into first laser heat load 10 at the requisite controlled input temperature. The output coolant from first laser heat load 10, is fed into second laser heat load 12. The output coolant from second laser heat load 12, flows, via hot water reservoir input line 16 to hot water reservoir 56.

At the same time, valve $V_3$ is opened and pump 24 feeds warm coolant from hot water reservoir 56 through hot water reservoir output line 18 and cooling system 20 to return chilled water, via cold water reservoir input line 22, to cold water reservoir 54. This evaporator water loop circulates at a flow rate of X lbm/sec. Thus, water is removed from cold water reservoir 54 at a net rate of 2X lbm/sec and water is added to hot water reservoir at a net rate of 2X lbm/sec. At the end of, say, a four second laser firing cycle, cold water reservoir 54 contains 170–8X lbm of water and hot water reservoir 56 contains 8X lbm of high temperature water.

During the "heat load off" stage, valve $V_2$ is closed and warm coolant is removed from hot water reservoir 56 at a flow rate of X lbm/sec. The warm coolant is fed from hot water reservoir 56 through hot water reservoir output line 18 and cooling system 20 to return water, via cold water reservoir input line 22, to cold water reservoir 54. At the end of the cycle, hot water reservoir 56 contains no water and cold water reservoir 54 contains 170 lbs. of water. The water in cold water reservoir 54 is ready to act as coolant for another laser firing sequence.

The table below summarized the above operations:

| Operating Condition | Valve Positions | Pump Operations | Heat Load Water Loop Flow (lbm/sec) | Evaporator Water Loop Flow (lbm/sec) |
|---|---|---|---|---|
| Cool Down | $V_1$ open<br>$V_2$ closed<br>$V_3$ closed | Pump 24 on<br>Pump 14 off | 0.0 | X |
| Heat Load On | $V_1$ closed<br>$V_2$ open<br>$V_3$ open | Pump 24 on<br>Pump 14 on | 3X | X |
| Heat Load Off | $V_1$ closed<br>$V_2$ closed<br>$V_3$ open | Pump 24 on<br>Pump 14 off | 0.0 | X |

In the above example, the average heat load requirements using the VCS system of the present invention, having water in a cold and hot reservoir for thermal storage and precise temperature control, is about one-third of the requisite instantaneous heat load at the laser.

In the above example, water is used as the coolant. The present invention is not limited to water, as any conventional coolant may be used so long as it does not effect the operation of the heat load. When a laser is the heat load, water or a water/alcohol mixture is preferred. In a laser system, a coolant that has a different index of refraction may result in undesired effects to the laser pulse. However, in other systems, such as cooling systems for mission control avionics or wing-embedded sensors, any coolant may be used. For example, polyalphaolefin (PAO) is useful for its good dielectric properties as well as its low freezing point.

The number of VCS packs required to cool the water is a function of the time interval between laser firings (off time) and the heat removal capacity of the VCS Pack. The longer the off time, the lower the average heat load and the fewer required VCS packs. Alternatively, the water reservoir weight penalty can be reduced by using a larger capacity VCS Pack.

Further variations are within the scope of the present invention. For example, the heat load may be any heat source in need of cooling wherein cooling can be effected through a flowing liquid coolant. For example, the heat load may be an aviation-related heat load, such as mission control avionics or wing-embedded sensors. Other machines requiring cooling, such as injection molding machines, may also benefit from the VCS system of the present invention. The cooling system is not limited to using VCS packs, and may be any cooling means capable of cooling a flowing liquid coolant.

The above example describes a VCS system using one cold water reservoir and one hot water reservoir. However, the present invention is not intended to be limited to such an embodiment. Any number of cold water reservoirs and any number of hot water reservoirs may prove useful in a VCS system of the present invention, depending on the desired functionality. For example, a plurality of cold and hot water reservoirs may be employed to create the most efficient use of available space and tubing.

The above example describes a VCS system for cooling a first and a second laser heat load in series. However, the present invention is not intended to be limited to such an embodiment. Any number of head loads, either in series or in parallel, may be cooled by the cooling system of the present invention.

The vapor cycle system of the present invention, having cold and hot thermal reservoirs, offers significant reductions in the size, weight and power of the VCS equipment while providing for accurate temperature control of the coolant delivered to the heat load. The cold water reservoir stores thermally controlled coolant, having it immediately available for a heat load. The hot water reservoir receives the used coolant, allowing the coolant to pass through the coolant cooling means before being returned to the cold water reservoir. Such a system is especially useful in systems having a high intermittent heat load, such as high powered solid state lasers.

It should be understood, of course, that the foregoing relates to preferred embodiments of the invention and that modifications may be made without departing from the spirit and scope of the invention as set forth in the following claims.

I claim:

1. An apparatus for providing coolant to an intermittent heat load comprising:

a first coolant reservoir for providing coolant to said intermittent heat load, said intermittent heat load including at least one laser heat load;

a second coolant reservoir for receiving used coolant after passing through said intermittent heat load; and a cooling system;

said cooling system adapted for receiving said used coolant from said second coolant reservoir, cooling said used coolant, and supplying usable coolant to said first coolant reservoir;

wherein said cooling system is sized for an average heat load of said intermittent heat load.

2. The apparatus according to claim 1, wherein said at least one laser heat load comprises a first laser heat load in series with a second laser heat load.

3. The apparatus according to claim 1 further comprising:

a diaphragm covering an air/coolant boundary within each of said first coolant reservoir and said second coolant reservoir; and an air pressure line for supplying a force on said air/coolant boundary, whereby as a coolant level in said first and second coolant reservoirs is changed, said diaphragm remains at said air/coolant boundary.

4. The apparatus according to claim 3, wherein said air pressure line delivers pressurized air onto a diaphragm surface opposite to a diaphragm surface covering said air/coolant boundary.

5. The apparatus according to claim 1, further comprising:

a temperature sensor in said first coolant reservoir monitoring a temperature of said coolant in said first coolant reservoir;

wherein said cooling system cools said coolant in said first coolant reservoir when said temperature sensor measures a coolant temperature greater than a predetermined desired coolant temperature.

6. The apparatus according to claim 5, wherein said apparatus further comprises:

a cooldown loop output line, communicating said coolant between said first coolant reservoir and said cooling system; and a first coolant reservoir input line, communicating said coolant at said predetermined desired coolant temperature between said cooling system and said first coolant reservoir.

7. The apparatus of claim 6, further comprising a valve in said cooldown loop output line for regulating the flow of coolant through said cooldown loop output line.

8. The apparatus according to claim 2, wherein said cooling system includes a condenser, an evaporator, and at least one vapor cycle system (VCS) pack.

9. The apparatus according to claim 2, wherein said coolant is a liquid coolant.

10. A method for providing coolant to an intermittent heat load comprising:

providing a first coolant reservoir and a second coolant reservoir;

chilling said coolant in said first coolant reservoir to provide a usable coolant;

passing said usable coolant from said first coolant reservoir through said intermittent heat load to said second coolant reservoir, said intermittent heat load including at least one laser heat load, said usable coolant becoming used coolant after passing through said intermittent heat load; and passing said used coolant from said second coolant reservoir, through a cooling system, back to said first coolant reservoir, said used coolant becoming usable coolant after passing through said cooling system;

wherein said cooling system is sized for an average heat load of said intermittent heat load.

11. The method according to claim 10, wherein said at least one laser heat load comprises a first laser heat load in series with a second laser heat load.

12. The method according to claim 10 further comprising:

covering an air/coolant boundary within each of said first coolant reservoir and said second coolant reservoir with a diaphragm; and supplying a force on said air/coolant boundary, whereby as a coolant level in said first and second coolant reservoirs is changed, said diaphragm remains at said air/coolant boundary.

13. The method according to claim 10, wherein said cooling system includes a condenser, an evaporator, and at least one vapor cycle system (VCS) pack.

14. The method according to claim 10, wherein said coolant is a liquid coolant.

15. An apparatus for cooling an intermittent laser heat load comprising:

a first coolant reservoir;

a second coolant reservoir;

a heat load coolant loop for circulating coolant from said first coolant reservoir, to said intermittent laser heat load, and for returning used coolant to said second coolant reservoir;

a cooling system; and an evaporator coolant loop circulating used coolant from said second coolant reservoir, through said cooling system, cooling said coolant, and supplying coolant to said first coolant reservoir;

wherein the cooling system is sized for an average heat load of the intermittent laser heat load.

16. The apparatus according to claim 15, wherein said intermittent laser heat load comprises a first intermittent laser heat load in series with a second intermittent laser heat load.

17. The apparatus according to claim 15, further comprising:

a diaphragm covering an air/coolant boundary within each of said first coolant reservoir and said second coolant reservoir; and an air pressure line for supplying a force on said air/coolant boundary, whereby as a coolant level in said reservoirs is changed, said diaphragm remains at said air/coolant boundary, wherein said air pressure line delivers pressurized air onto a diaphragm surface opposite to a diaphragm surface covering said air/coolant boundary.

18. The apparatus according to claim 15, further comprising:

a temperature sensor in said first coolant reservoir for monitoring a temperature of said coolant in said first coolant reservoir;

reservoir coolant cooling means for cooling coolant in said first coolant reservoir when said temperature sensor measures a coolant temperature greater than a predetermined desired coolant temperature.

19. The apparatus according to claim 18, wherein said reservoir coolant cooling means includes:

a cooldown loop output line for communicating said coolant between said first coolant reservoir and said cooling system; and a first coolant reservoir input line for communicating said coolant at said predetermined desired coolant temperature between said cooling system and said first coolant reservoir.

20. The apparatus of claim 19, further comprising a valve in said cooldown loop output line for regulating the flow of coolant through said cooldown loop output line.

21. The apparatus according to claim 15, wherein said cooling system includes a condenser, an evaporator, and at least one vapor cycle system (VCS) pack.

22. The apparatus according to claim 15, wherein said coolant is a liquid coolant.

23. The apparatus of claim 15, further comprising a valve for controlling the flow of coolant through said heat load coolant loop.

24. A coolant providing system for cooling an intermittent laser heat load comprising:

a first coolant reservoir for storing coolant chilled to a predetermined temperature;

a second coolant reservoir for receiving used coolant;

a heat load coolant loop communicating said first coolant reservoir with said intermittent laser heat load, and said laser heat load with said second coolant reservoir;

a first pump circulating said coolant through said intermittent laser heat load in said heat load coolant loop;

a cooling system having a condenser, an evaporator, and at least one vapor cycle system (VCS) pack;

an evaporator coolant loop communicating said second coolant reservoir with said cooling system, and said cooling system with said first coolant reservoir; and a second pump circulating said used coolant through said cooling system in said evaporator coolant loop, whereby said used coolant is chilled to said predetermined temperature to provide a usable coolant and said usable coolant is returned to said first coolant reservoir;

wherein the cooling system is sized for an average heat load of the intermittent laser heat load.

25. The coolant providing system according to claim 24 wherein said intermittent laser heat load comprises at least a first intermittent laser heat load and a second intermittent laser heat load.

26. The coolant providing system according to claim 24, further comprising:

a first reservoir cooldown loop communicating coolant between said first coolant reservoir and said cooling system, and between said cooling system and said first coolant reservoir;

a pump in said first reservoir cooldown loop for circulating said coolant;

first reservoir cooldown loop activating means for activating said first reservoir cooldown loop when a temperature of said coolant in said first coolant reservoir is above said predetermined temperature, whereby precision control of the coolant temperature in said first coolant reservoir is maintained.

27. The coolant providing system according to claim 24, further comprising:

a diaphragm covering an air/coolant boundary within each of said first coolant reservoir and said second coolant reservoir; and an air pressure line for supplying a force on said air/coolant boundary, whereby as a coolant level in said first and second coolant reservoirs is changed, said diaphragm remains at said air/coolant boundary, wherein said air pressure line delivers pressurized air onto a diaphragm surface opposite to a diaphragm surface covering said air/coolant boundary.

28. The coolant providing system of claim 24, further comprising a valve for controlling the flow of coolant through said heat load coolant loop.

29. A method of providing thermal control to a first laser heat load and a second laser heat load, comprising:

opening a first valve, said first valve in fluid communication with a first pump;

pumping ambient temperature coolant, with the first pump, through a hot coolant reservoir output line and a cooling system;

cooling the ambient temperature coolant to produce an output coolant;

returning the output coolant to a cold coolant reservoir via a cold coolant reservoir input line;

closing the first valve;

opening a second valve, said second valve in fluid communication with a second pump;

pumping coolant, with the second pump, from the cold coolant reservoir into the first laser heat load, to produce an output coolant;

feeding the output coolant from the first laser heat load into the second laser heat load;

flowing the output coolant from the second laser heat load to a hot coolant reservoir via a hot coolant reservoir input line;

opening a third valve, said third valve in fluid communication with the first pump;

pumping warm coolant, with the first pump, from the hot coolant reservoir through a hot coolant reservoir output line and the cooling system, to produce chilled coolant;

returning the chilled coolant to the cold coolant reservoir via the cold coolant reservoir input line;

closing the second valve;

feeding coolant from the hot coolant reservoir through the hot coolant reservoir output line and the cooling system; and returning the coolant to the cold coolant reservoir via the cold coolant reservoir input line.

* * * * *